US006402911B2

(12) United States Patent
Zabelin et al.

(10) Patent No.: US 6,402,911 B2
(45) Date of Patent: Jun. 11, 2002

(54) APPARATUS FOR THE PRODUCTION OF MAGNESIUM

(75) Inventors: Igor V. Zabelin; Georgy M. Shehovtsov; Vladimir N. Deviatkin; Irina L. Sikorskaya, all of Zaporizhzya (UA); Alexander M. Tatakin, St. Petersburg (RU); Tatiana V. Zabelina, Zaporizhzya (UA)

(73) Assignee: State Research And Design Institute Of Titanium, Zaporizhzhya (UA)

( * ) Notice: Subject to any disclaimer, the term of this patent is extended or adjusted under 35 U.S.C. 154(b) by 0 days.

(21) Appl. No.: 09/740,736

(22) Filed: Dec. 19, 2000

(30) Foreign Application Priority Data

Dec. 20, 1999 (UA) ..... 99126927

(51) Int. Cl.[7] ..... C25C 3/00

(52) U.S. Cl. ..... 204/245; 204/247; 204/243.1; 204/244

(58) Field of Search ..... 204/243.1, 244, 204/245, 247; 205/354, 357, 367, 402, 404, 405

(56) References Cited

U.S. PATENT DOCUMENTS

| | | | | | |
|---|---|---|---|---|---|
| 4,073,703 | A | * | 2/1978 | Kinosz et al. | 204/247 |
| 4,308,116 | A | * | 12/1981 | Andreassen et al. | 204/245 |
| 4,334,975 | A | * | 6/1982 | Ishizuka | 204/247 |
| 4,518,475 | A | * | 5/1985 | Sivilotti | 204/247 |
| 4,560,449 | A | * | 12/1985 | Sivilotti | 204/245 |
| 5,198,078 | A | * | 3/1993 | Gale et al. | 204/245 |
| 5,415,742 | A | * | 5/1995 | La Camera et al. | 204/245 |

* cited by examiner

*Primary Examiner*—Bruce F. Bell
(74) *Attorney, Agent, or Firm*—Lawrence G. Fridman

(57) ABSTRACT

An apparatus for electrolytic production of magnesium includes a plurality of upright anode elements interspread with a plurality of cathode elements situated within at least one electrolysis compartment. At least one section, defined between two adjacent anodes and having an elongated loading inlet, is provided for receiving and melting of a substantially solid raw material. A gas discharging outlet is formed for discharging of chlorine gas developed at the plurality of anodes. A baffle is supported by the receiving anodes in the vicinity of the gas discharging outlet. The baffle prevents direct flow of a mixture of chlorine gas and fine dust particles resulted from loading of the solid raw material between the section and gas discharging outlet.

11 Claims, 5 Drawing Sheets

APPARATUS FOR THE PRODUCTION OF MAGNESIUM

BACKGROUND OF THE INVENTION

1. Field of the Invention

The invention relates to the metallurgy of non-ferrous metals, and in particular, to the electrolytic production of magnesium in a continuous process line.

2. Description of the Prior Art

Metallic magnesium is produced by passing direct electric current between anodes and cathodes suspended in facing spaced relation in a molten salt bath containing magnesium chloride, within an enclosed cell chamber. The electrolysis of magnesium chloride in the bath, causes molten magnesium metal to be released at the cathode surfaces while chlorine gas is generated at the anode surfaces. The metal, being lighter than the bath, rises along the cathode surfaces, while the gas rises through the bath in a plume of bubbles from each anode surface to collect in a gas space within a working space above the level of the bath. A solid or semi-solid chlorine-magnesium raw material is utilized in the production of magnesium in the continuous production lines. This raw material is loaded either into a process area of an electrolytic cell or into a special melting device forming a part of the continuous production line. It is typically recommended to load the solid chlorine-magnesium raw material at a surface of a bath in the electrolysis compartment of the cell.

An example of an apparatus for electrolytic production of magnesium is provided by U.S. Pat. No. 4,308,116. The electrolytic cell disclosed by the patent contains a special section adapted for receiving and melting a solid magnesium chloride. An upwardly extending gas exhaust bell is formed for evacuation of gases from the electrolysis section. The bell includes a feeding pipe for loading a solid raw material.

A cross-wall extends transversely in the electrolysis compartment. It separates the cathodes in the electrolysis compartment, restricts the treatment time of the non-molten material in the electrolytic section and contributes to the discharging thereof into the metal collecting chamber. In the metal collecting chamber, the non-molten raw material is mixed with the molten metal, resulting in an undesirable solidification of the former. Another important drawback of this patent is that the loading of solid material takes place in the vicinity of the cross-wall. The losses are especially increased when solid carnallite is utilized as a raw material. This is because the required volume of the loaded material per unit of the electrical current intensity is doubled in this case, compared to the loading of magnesium chloride.

Furthermore, loading of a free flowing solid or semisolid raw material into the area adapted for evacuation of the anode gasses leads to contamination of the gasses by fine particles or of the raw material dust.

Another example of the electrolytic cell according to the prior art is illustrated in FIG. 1. A section for loading and melting of a solid raw material is formed between two supporting anodes 13. After loading of the raw material, as illustrated by the arrows, the flow of chlorine gas contaminated by a dust moves directly to a rear wall 29 and a gas discharging outlets 17. A short distance between the loading area and the gas discharging outlets does not provide enough space for efficient separation of the chlorine gas from the dust particles of the raw material. Thus, the degree of contamination of the aspirated gases within the gas evacuation system is high. Therefore, further utilization of the anode gases in this prior art arrangement requires additional steps of cleaning, which ultimately increases operational costs of the system.

SUMMARY OF THE INVENTION

One aspect of the invention provides an apparatus for electrolytic production of magnesium including at least one electrolysis compartment and at least one metal collecting compartment separated from each other by a partition wall. A plurality of upright anode elements is interspread with a plurality of cathode elements within the electrolysis compartment. The electrolysis compartment is formed with at least one section for receiving and melting of a substantially solid raw material. Each section is defined between two adjacent receiving anodes and has an elongated loading inlet for directing of the substantially solid raw material. At least one gas discharging outlet is provided for discharging of chlorine gas developed at the plurality of anodes. A baffle is supported by the receiving anodes at ends thereof remote from the partition wall and in the vicinity of the gas discharging outlet. The baffle prevents direct flow of a mixture of chlorine gas and a dust resulted from loading of the substantially solid raw material into the gas discharging outlet. The baffle diverts the flow away from the gas discharging outlet and toward the partition wall prior to entering the gas discharging outlet.

As to another aspect of the invention, a gap is formed between an end of each receiving anode and the partition wall, so that the mixture before entering the gas discharging outlet passes through gaps between the receiving anodes and the partition wall substantially extending the route of the flow of the mixture and enhancing separation of the chlorine gas from the dust.

As to a further aspect of the invention, the baffle is formed with top, bottom and side portions. The top portion engages an upper closure of the electrolysis compartment, the side portions are supported by the receiving anodes and the bottom portion is submerged into the electrolyte.

According to still another aspect of the invention, spaces between two receiving adjacent anodes in each loading and melting section are greater than the spaces between the remaining adjacent electrodes in the electrolysis compartment. Each loading and melting section further includes at least two cathodes positioned between the receiving anodes and spaced from each other at a distance substantially equal to 2–3 average spaces between the remaining adjacent electrodes in the electrolysis compartment. The height of the cathodes in the loading and melting section is about 1.05–1.015 of the remaining cathodes in the electrolysis compartment.

According to a still further aspect of the invention, the elongated loading inlet is in the form of a pipe-shaped member which is spaced from the rear ends of the anodes in the electrolysis compartment at a distance substantially equal to 0.25–0.33 of the width of the anodes. Each metal collecting compartment is formed with at least one internal cover facing the direction of electrolyte and at least one external cover. The gas aspiration from the area under the internal cover is connected to a system of gas evacuation from the electrolysis compartment. A system of sanitary gas evacuation is located between the external and internal covers.

The present invention causes increase of the service life of the electrolytic cell which utilizes a solid raw material and reduces the cost of magnesium production. This is due to the increased durability of its structural elements. The lower portion of the curtain or the dividing partition is made of molten-cast materials, such as for example, korvishite. The upper portion of the partition is formed from materials of mullite type or refractory concrete. These materials are less sensitive to heat changes. Korvishite is more resistant to the melts containing impurities of hydrogen chloride.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF THE PREFERRED EMBODIMENT

Figure 1:
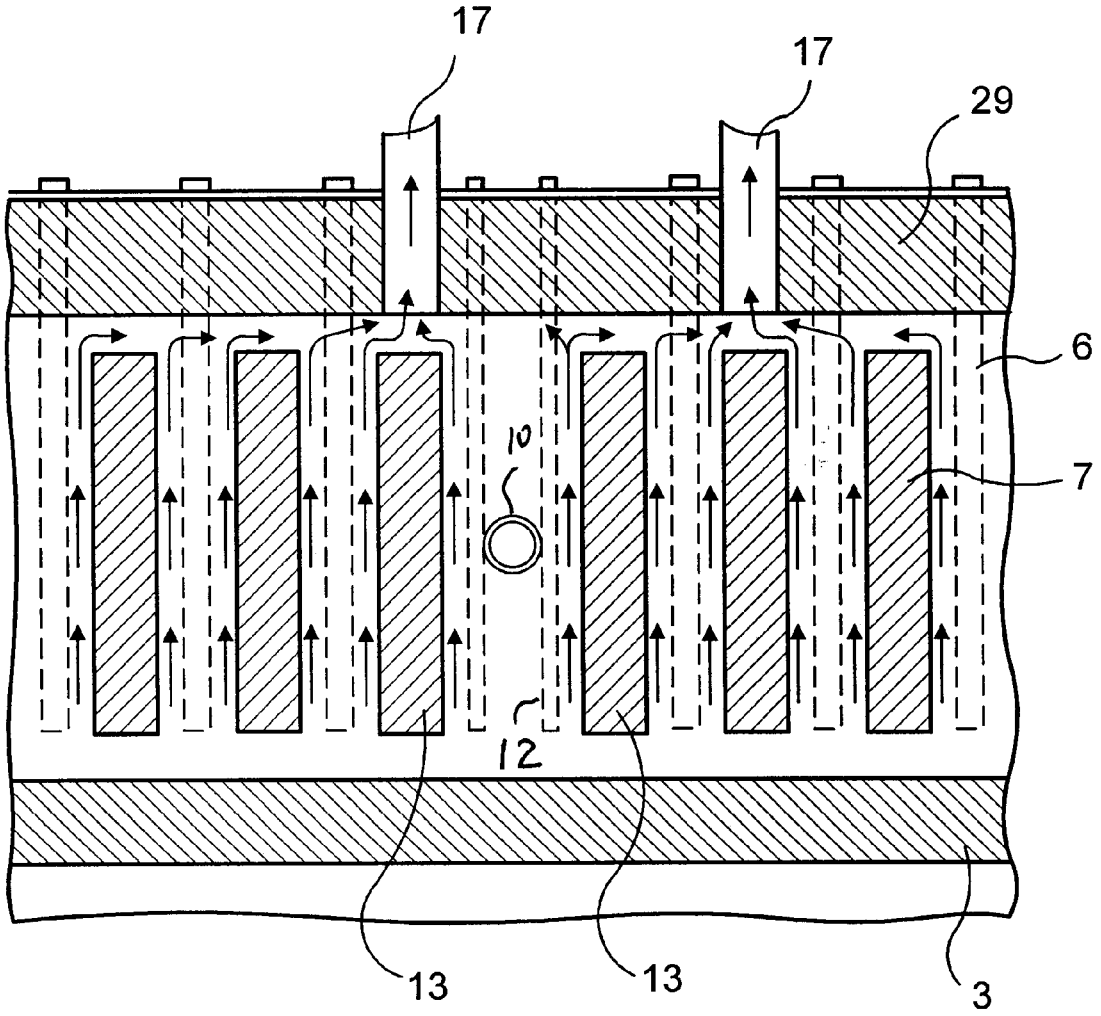
F I G. 1 PRIOR ART
FIG. 1 is a schematic partial top plan view of an electrolytic cell according to the prior art.

Referring now to FIGS. 1–6 wherein the preferred embodiment of the electrolytic cell of the invention for production of magnesium is illustrated. A housing 20 of the electrolytic cell is a refractory wall structure formed with an electrolysis compartment 4 which is separated from a metal collecting compartment 5 by a refractory curtain or partitioning wall 3. Although one electrolysis and metal collecting compartments are illustrated by the drawings, electrolytic cells with a plurality electrolysis and of metal collecting compartments are within the scope of the invention.

The curtain wall 3 extends substantially upwardly within the refractory housing of the electrolytic cell from an area at the bottom floor to a top part thereof. The walls and the floor of the electrolytic cell can be made of heavy refractory construction utilizing refractory blocks.

Each curtain wall 3 contains first operational openings 22 and second operational openings 24 separated by a solid portion of the wall. The first operational openings 22 are provided at an upper region of the curtain wall, whereas the second operational openings 24 are situated at the floor area.

The electrolysis compartment 4 includes a gas discharge outlet duct 17 at its upper portion for removal of chlorine gas. The electrolysis compartment 4 is enclosed at the top by a refractory lined closure 11, so as to form a gas-tight seal therebetween.

Figure 2:
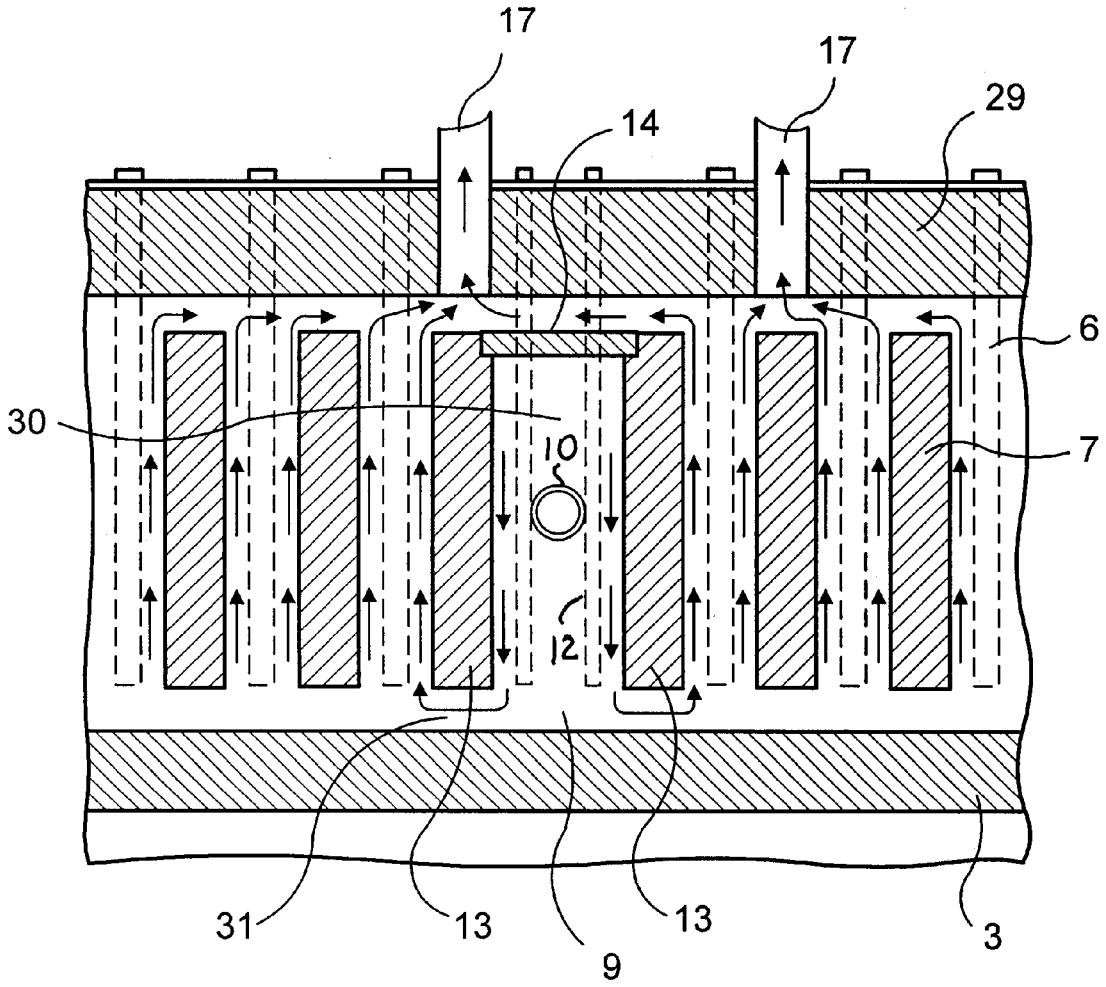
FIG. 2 is a schematic partial top plan view of the electrolytic cell of the invention.

A multiplicity of anodes 7 and cathodes 6 form a part of the electrolysis compartment 4. A plurality of heavy, plate-like graphite anodes 7 are mounted in the top closure 11, so as to project downward into the electrolysis compartment 4 with their lower edges near the bottom of the latter. Position of each anode is such that its longitudinal dimension extends from the front to the rear of the compartment 4. As best illustrated in FIG. 2 longitudinally the anodes 7 extend between the partition wall 3 and the rear wall 29 of the sell. A suitable electrical connecting means 8 is provided at the upper ends of the anodes 7. In addition, cooling means is formed for extracting heat from the anodes. The electrolysis compartment 4 also includes a plurality of cathodes 6 which may consist of steel plates. The cathodes 6 are arranged at localities between successive anodes, so that the electrodes alternate in mutually parallel arrays along the electrolysis compartment. The cathodes 6 also extend longitudinally within the electrolysis compartment. The cathodes that are disposed between pairs of anodes are arranged in spaced pairs and carried by suitable mounting and electrical connecting structure which extends through the wall and has a suitable connection means. The cathodes of each described pair are disposed suitably close to the respective adjacent anodes.

The walls of the cell are made of heavy refractory construction and can be conveniently built of refractory blocks. The entire structure may have an outer insulating layer and an outer steel casing 1 is provided for strength and protection. At least one gas discharging outlet 17 is provided for discharging of a chlorine gas released at the plurality of anodes 7. The gas discharging outlets 17 are situated at the rear wall 29 and in the vicinity of the rear ends of receiving anodes 13.

Multiple sections 9 adapted for receiving and melting of substantially solid raw materials, such as solid carnallite, are formed within each electrolysis compartment 4. Each loading and melting section 9 contains two receiving cathodes 12 located between two receiving anodes 13, so that working surfaces of these cathodes are oriented in the direction of the receiving anodes. An elongated loading inlet 10 is provided for directing of the substantially solid raw material into an area 30 between the supporting anodes 13.

The apparatus of the invention utilizes fragmented solid raw material which is subject to additional fragmentation during transportation and loading. Thus, upon loading of the raw material through the elongated loading inlet 10 on the surface of electrolyte in the section 9, formation of fine dust particles within the receiving area 30 is inevitable.

Figure 3:
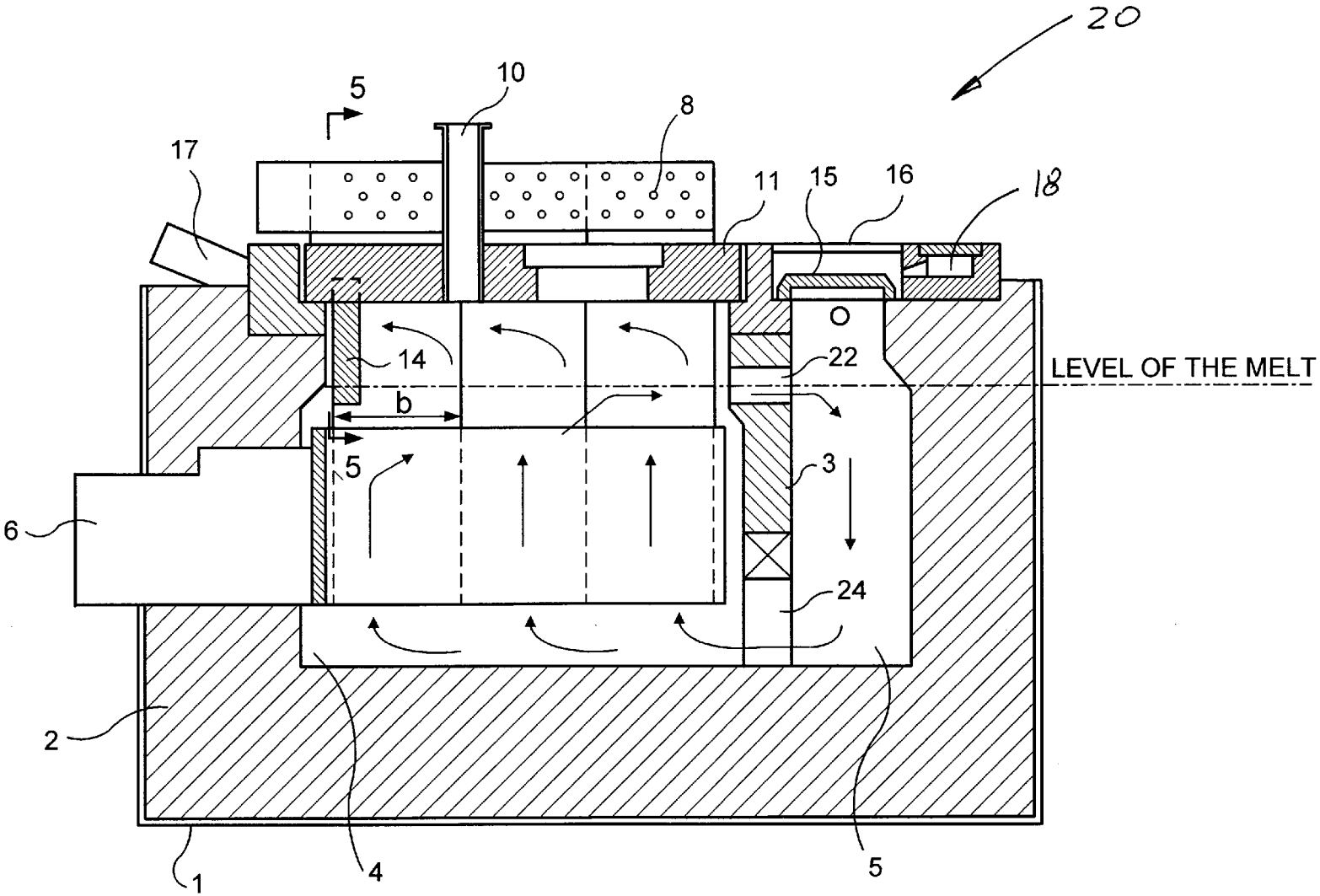
FIG. 3 is a vertical cross section of the electrolytic cell of the invention.
Figure 5:
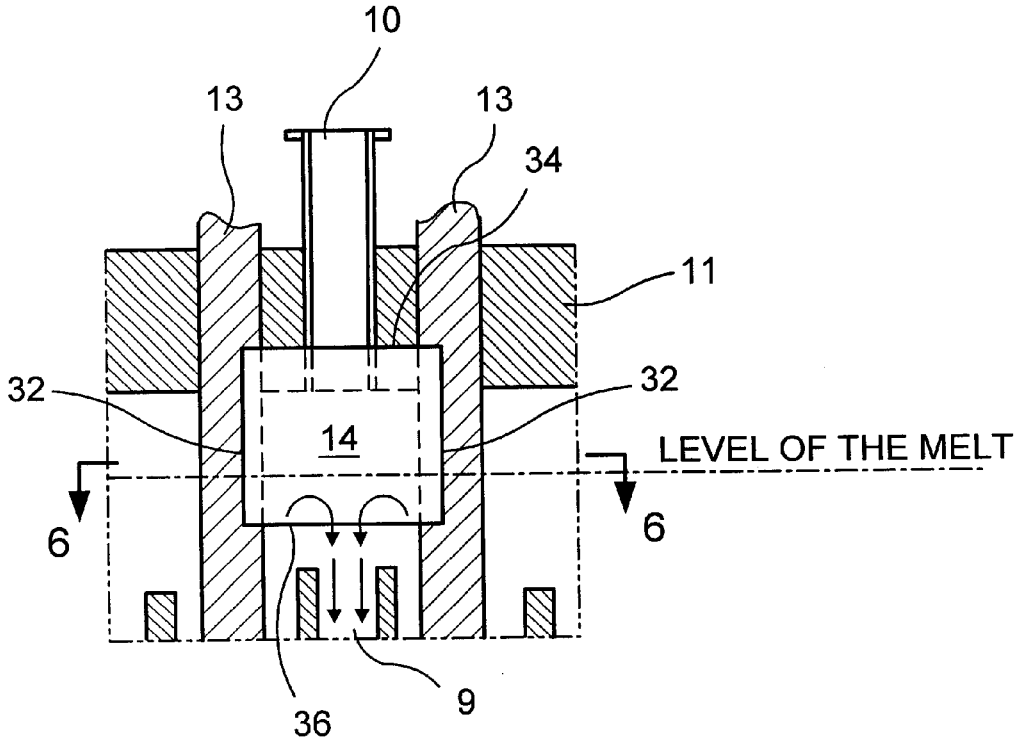
FIG. 5 is a partial elevational view according to section line 5—5 of FIG. 3.
Figure 6:
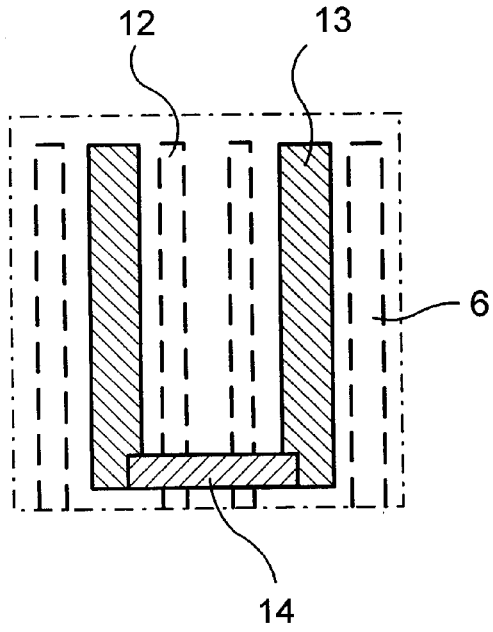
FIG. 6 is a partial section view according to section line 6—6 of FIG. 5.

Each section 9 contains a baffle 14 situated between the receiving anodes 13 at the ends thereof remote from the partition wall 3 and in the vicinity of the gas discharging outlets 17. The baffle 14 is formed with top 34, bottom 36 and side 32 portions. As best illustrated in FIGS. 3 and 5, the top portion 34 of the baffle 14 engages an upper closure 11 of the electrolysis compartment and the side portions 32 are supported by the respective receiving anodes 13. The bottom portion 36 extends downwardly below the level of the melt or electrolyte. To facilitate installation of the baffle 14, portions of the receiving anodes 13 facing the rear wall 29 are formed with C-shaped channels adapted for close receiving of the side portions 32. A refractory adhesive material, such as a refractory glue or cement, is utilized to permanently secure the baffle 14 to the receiving anodes 13.

The baffle 14 is typically made of materials resistant to the operational conditions of the electrolytic cell. An example of such materials is a refractory concrete.

One of the important objects of the invention is to minimize contamination of the discharged chlorine gas by particulates of the raw material. For this purpose, as best illustrated in FIG. 2, the area 30 between the receiving anodes 13, located above the level of electrolyte, is isolated by the baffle 14 from the rear wall 29. The structure precludes direct communication between the receiving area 30 and the gas discharging outlets 17.

In view of the installation of the baffle 14 in a manner discussed hereinabove, the flow of chlorine gas contaminated by the fine particles of solid raw material or dust is, prior to entering the gas discharging outlets 17, is directed toward the partition wall 3, through the passages 31 and along the outer surfaces of the receiving anodes 13. Such diversion substantially extends the travel passage of the contaminated chlorine gas and enhances separation of the chlorine gas from the dust particles. This ultimately reduces the degree of contamination of the aspirated gases within the gas evacuation system.

In the preferred embodiment of the invention, the distance "a" between the receiving cathodes 12 in each section 9 (see FIG. 4) does not exceed 2–3 average distances between the remaining electrodes of the electrolysis compartment. Further increase of the distance "a" results in insufficient utilization of the electrodes. However, when the distance "a" is less than two distances between the remaining electrodes in the electrolysis compartment, hydrodynamic resistance to the flow of electrolyte within the vertical channels between the receiving cathodes 12 is substantially increased. This causes undesirable movement of the electrolyte flow in the loading and melting section 9 which brings the non-molten carnallite into the metal collecting compartment 5.

Figure 4:
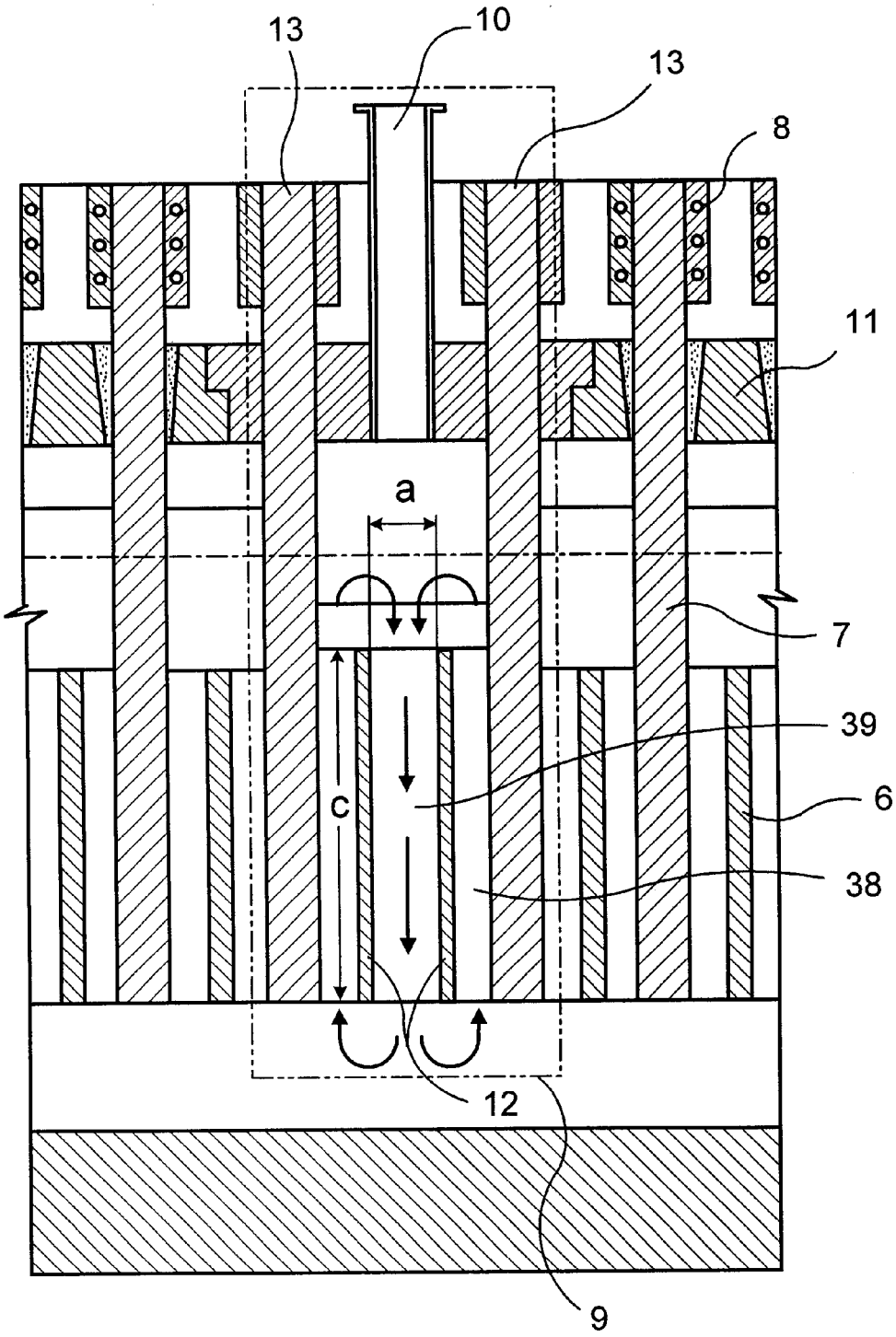
FIG. 4 is a partial sectional view of the electrolytic cell of the invention showing a loading and melting section.

The flow of electrolyte does not circulate in the spaces between the electrodes in the loading and melting section 9 in a manner similar to that of the remaining electrolysis compartment. In the loading and melting section 9, as best illustrated in FIG. 4, the flow of electrolyte is directed upwardly in the spaces between the receiving anodes 13 and the receiving cathodes 12. The downward movement of the electrolyte is through the channels formed between the receiving cathodes 12. At the upper region of the cathodes 12, where the change in the direction of electrolyte flow has taken place, the flow of electrolyte moves within the plane substantially normal to the surfaces of the electrodes.

Thus, in the section 9, the flow of the melt does not move toward the metal collecting compartment, but is directed downwardly toward the bottom of the cell within the channel between the receiving cathodes 12 forming suction-type circulation. This circulation contributes to more intensive mixing of the solid raw material or solid carnallite with the melt and enhances the dissolving of the raw material within the bath. This process is optimized when the ratio of the height "c" (see FIG. 4) of the receiving cathodes 12 to the height of the remaining cathodes in the electrolysis compartment 4 is between 1.05–1.15:1.00, respectively.

Furthermore, to minimize the possibility for the non-molten raw material or carnallite to enter the metal collecting compartment 5, the loading inlet or branch pipe 10 is positioned in the close vicinity to the rear wall 29 of the cell. In this respect, he elongated loading inlet 10 is positioned at a distance "b" from the rear ends of the anodes (see FIG. 3). In the preferred embodiment of the invention, the distance "b" is between 0.25 and 0.33 of the width of the anodes.

The rate of the melting of the solid raw material or carnallite is increased by forming the electrical connecting arrangement of the receiving anodes 13 without the cooling means. This is one of the distinctions between the receiving anodes 13 of the loading and melting section 9, and the remaining anodes 7 of the electrolysis compartment 4.

In the electrolysis compartment, the flow of electrolyte moves within the plane substantially parallel to the planes of electrodes. Thus, the Flow of electrolyte carries magnesium through the top operational openings 22 of the curtain wall or refractory partition 3 into the metal collecting compartment 5.

The curtain wall or refractory partition 3 is made of various refractory materials. For example, the lower part of the curtain 3 typically submerged into the melt is made of the fused cast materials, whereas mullite or refractory concrete are used to form the upper part thereof surrounded by the gaseous phase.

As illustrated in FIG. 3, an upper region of each metal collecting compartment 5 is formed with two covers. A lower cover 15 facing the direction of electrolyte is typically made of refractory concrete. An exterior or upper cover 16 is made of a metal such as steel. A system for aspiration of gases from an area of the metal collecting compartment 5 below the lower cover 15 is connected with the system of gas evacuation of the electrolysis compartment 4. The inlet 18 to a system of sanitary gas evacuation is located within a space between the upper 15 and lower 16 covers of the metal collecting compartment 5.

In operation of the apparatus of the invention, the electrolysis compartment 4 is filled to a predetermined level with the electrolyte or electrolytic bath containing magnesium chloride. By means of a suitable source of energy, a direct electric current is passed through the bath between the working surfaces of the anodes 7 and cathodes 6 facing each other. Continuous passage of the electrical current results in electrolysis of the molten chemicals. Free magnesium metal is deposited in the molten state on the surfaces of the cathodes 6. Since the magnesium metal is lighter than the bath, it flows upwardly along the working surfaces of the cathodes to be ultimately received and accumulated in the collecting compartment 5. Simultaneously, the chlorine gas is continuously evolved at the anodes 7 and rises from the anodes to be collected in a gas space above the electrolysis compartment 4 and is discharged through the port or gas discharging outlets 17.

Chlorine gas released at the anodes 7 upon reaching a top surface of the electrolyte, is separated therefrom and evacuated from the electrolysis compartment through the discharging outlets 17 of the gas evacuation system. The discharging outlets in the form of the branch pipes 17 are located at the rear wall 29 of the cell.

Magnesium which is carried out into the metal collecting compartment 5 by the flow of electrolyte appears on the surface of the melt and is periodically taken out during individual maintenance of the cells. When the continuous production technology is utilized, magnesium can be transported into the special storage facility. The electrolyte from the metal collecting 5 is returned back through the lower operational openings into the electrolysis compartment 4.

Bubbles of the chlorine gas are carried out along with electrolyte and magnesium flow from the electrolysis compartment 4 into the metal collecting compartment 5. This chlorine is aspirated through the gas discharging outlets 17 into the system of gas evacuation from the electrolysis compartment 4.

The metal collecting compartment 5 is open and communicates with atmosphere when, for example, the slime is removed from the electrolytic cell. During this time the outlet 18 is disconnected from the system of gas evacuation from the electrolytic section 4. Upon reaching the metal collecting compartment 5, the chlorine gas is aspirated into the system of sanitary evacuation, so as to deliver the chlorine gas to the cleaning facilities.

Thus, utilization of the electrolytic cell of the invention for the production of magnesium enables the user to reduce the metal losses and to increase the quality of anode chlorine gas. This substantially reduces the production costs of magnesium metal.

What is claimed is:

1. An apparatus for electrolytic production of magnesium, including:

a housing formed with at least one electrolysis compartment and at least one metal collecting compartment separated from each other by a partition wall, a plurality of upright anode elements interspread with a plurality of cathode elements within said at least one electrolysis compartment;

said at least one electrolysis compartment formed with at least one section for receiving and melting of a substantially solid raw material, each said section being defined between two adjacent receiving anodes and having an elongated loading inlet for directing of said substantially solid raw material;

at least one gas discharging outlet for discharging of chlorine gas developed at said plurality of anodes;

a baffle supported by said receiving anodes at ends thereof remote from said partition wall and in the vicinity of the gas discharging outlet;

whereby said baffle prevents direct flow of a mixture of said chlorine gas and fine dust particles resulted from loading of said substantially solid raw material between said section and said gas discharging outlet, said baffle diverting said flow toward said partition wall prior to entering said gas discharging outlet.

2. The apparatus of claim 1, wherein a gap is formed between ends of said supporting anodes and said partition wall, said mixture before entering said gas discharging outlet passes through said gaps between said supporting anodes and said partition wall substantially extending route of the flow of said mixture and enhancing separation of the chlorine gas from said fine dust particles.

3. The apparatus of claim 2, wherein said baffle is formed with top, bottom and side portions, said top portion engages an upper closure of the electrolysis compartment, said side portions supported by the respective receiving anodes, and said bottom portion is submerged into an electrolyte.

4. The apparatus of claim 3, wherein said bottom portion of the baffle is formed of a heat resistant material and an upper portion of said partition wall is formed of a heat resistant material.

5. The apparatus of claim 1, wherein spaces between two receiving adjacent anodes in each said loading and melting section are greater than spaces between remaining adjacent anodes in the electrolysis compartment.

6. The apparatus of claim 5, wherein each said loading and melting section further comprises at least two receiving cathodes positioned between said receiving anodes and spaced from each other at a distance substantially equal to 2–3 average spaces between the adjacent electrodes in the electrolysis compartment.

7. The apparatus of claim 6, wherein height of said receiving cathodes in each said loading and melting section is about 1.05–1.015 of height of the remaining cathodes in the electrolysis compartment.

8. The apparatus of claim 1, wherein said elongated inlet is in the form of a pipe-shaped member, a longitudinal axis of said pipe-shaped member is spaced from rear ends of the anodes in the electrolyze compartment at a distance substantially equal to 0.25–0.33 of width of said anodes.

9. The apparatus of claim 1, wherein each said metal collecting compartment is formed with at least one internal cover facing the direction of electrolyte and at least one external cover.

10. The apparatus of claim 9, wherein said internal cover is made of a refractory concrete and said external cover is made of a metal.

11. The apparatus of claim 9, wherein a system of gas aspiration from an area below said at least one internal cover is connected with a system of gas evacuation from the electrolysis compartment and a system of sanitary gas evacuation is located between said external and internal covers.

* * * * *